US008616385B1

(12) United States Patent
Doran

(10) Patent No.: US 8,616,385 B1
(45) Date of Patent: Dec. 31, 2013

(54) DUGOUT ORGANIZATION SYSTEM

(71) Applicant: John Doran, Cypress, CA (US)

(72) Inventor: John Doran, Cypress, CA (US)

( * ) Notice: Subject to any disclaimer, the term of this patent is extended or adjusted under 35 U.S.C. 154(b) by 0 days.

(21) Appl. No.: 13/903,685

(22) Filed: May 28, 2013

Related U.S. Application Data

(63) Continuation-in-part of application No. 13/554,283, filed on Jul. 20, 2012, now abandoned, which is a continuation-in-part of application No. 12/780,885, filed on May 15, 2010, now Pat. No. 8,245,858.

(51) Int. Cl.
*A47F 7/00* (2006.01)
*A47F 5/08* (2006.01)

(52) U.S. Cl.
USPC ..... 211/85.7; 211/87.01; 248/304; 248/316.1

(58) Field of Classification Search
USPC ..... 211/66, 70.2, 70.5, 70.6, 70.7, 70.8, 211/85.7, 87.01, 88.01, 113; 248/214, 215, 248/304, 314, 315, 316.1; D6/552
See application file for complete search history.

(56) References Cited

U.S. PATENT DOCUMENTS 3,178,141 A * 4/1965 Bloom ..... 248/113
3,650,407 A * 3/1972 Benham, Jr. ..... 211/14
3,653,624 A * 4/1972 Abel ..... 248/312
3,698,563 A * 10/1972 Gordon et al. ..... 211/85.7
4,583,647 A * 4/1986 Schinzing ..... 211/60.1
4,629,065 A * 12/1986 Braaten ..... 206/315.1
D306,385 S * 3/1990 Alexander et al. ..... D6/552
D309,226 S * 7/1990 Wilcox ..... D6/552
D314,302 S * 2/1991 Snow ..... D6/552
D356,002 S * 3/1995 Morgan ..... D6/552
5,413,228 A * 5/1995 Le Clerc ..... 211/13.1
5,462,328 A * 10/1995 Chandler et al. ..... 294/143
D373,498 S * 9/1996 Young ..... D6/552
5,626,244 A * 5/1997 Mesna et al. ..... 211/60.1
D404,952 S * 2/1999 Bauer ..... D6/552
D417,113 S * 11/1999 Greaney et al. ..... D6/552
D417,807 S * 12/1999 McBarnette ..... D6/513
6,053,340 A * 4/2000 Cameron ..... 211/85.7
D431,137 S * 9/2000 McBarnette ..... D6/513
D451,254 S * 11/2001 Egan ..... D32/73
D460,652 S * 7/2002 Mahoney ..... D6/552
D479,423 S * 9/2003 Mahoney ..... D6/552
6,695,155 B1 * 2/2004 Sofy et al. ..... 211/87.01
6,749,074 B1 * 6/2004 Hileman et al. ..... 211/85.7
D493,056 S * 7/2004 Shornak ..... D6/552

(Continued)

OTHER PUBLICATIONS

"My Dugout Buddy"; Website, mydugoutbuddy.com, Dec. 1, 2011; Website accessed on May 27, 2013; Tustin, CA USA.

*Primary Examiner* — Joshua Rodden

(57) ABSTRACT

The present invention features a dugout organization system for baseball or softball equipment for use by a participant in a dugout. The system features a generally planar chain link fence panel located in an erect position having a plurality of formed chain link fence wires intertwined to form a mesh chain link fence surface. The system features a base member having a top attachment tongue that projects out and away from a base posterior surface. The top attachment tongue features a top attachment tongue first groove located on a top attachment tongue first side and a top attachment tongue second groove located on an opposing top attachment tongue second side. The base member flares from the top attachment tongue forming a first side shoulder on a base first side and a second side shoulder on a base second side and then tapers approaching a base bottom.

8 Claims, 6 Drawing Sheets

(56) References Cited

U.S. PATENT DOCUMENTS

| | | | | |
|---|---|---|---|---|
| 6,905,036 | B2 * | 6/2005 | Sofy et al. | 211/87.01 |
| D560,088 | S * | 1/2008 | Tracy | D6/552 |
| D567,560 | S * | 4/2008 | Byers | D6/553 |
| 7,434,699 | B2 * | 10/2008 | Stukenberg | 211/41.1 |
| 7,673,759 | B2 * | 3/2010 | Stukenberg | 211/41.7 |
| 7,784,624 | B1 * | 8/2010 | Pinto | 211/85.7 |
| 7,789,248 | B1 * | 9/2010 | Salerno et al. | 211/85.7 |
| 2006/0086878 | A1 | 4/2006 | Cormier | |
| 2007/0210228 | A1 * | 9/2007 | Brenner et al. | 248/311.2 |
| 2011/0174945 | A1 * | 7/2011 | Wood | 248/225.11 |

* cited by examiner

DUGOUT ORGANIZATION SYSTEM

CROSS REFERENCE

This application claims priority to U.S. non-provisional application Ser. No. 12/780,885 filed May 15, 2010, now U.S. Pat. No. 8,245,858, and U.S. non-provisional application Ser. No. 13/554,283 filed Jul. 20, 2012, now abandoned, the specifications of which are incorporated herein in their entirety by reference.

FIELD OF THE INVENTION

The present invention relates to sports organizing systems, or more specifically, organizing systems used in a dugout for baseball or softball.

BACKGROUND OF THE INVENTION

In many sports, various personal equipment components are required (or recommended) for participation or safety. For example, in baseball or softball, typical equipment includes items such as bats, balls, helmets, and gloves. In addition, various other personal items are often present at sporting events or practices such as sports drinks and towels. As a result, in a confined area such as a dugout, equipment and other items can easily become cluttered and disorganized leading to safety hazards and equipment damage when players run in and out of the dugout. The present invention features a dugout organization system for baseball or softball equipment for use by a participant in a dugout.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a dugout organization system for baseball or softball equipment for use by a participant in a dugout. In some embodiments, the system comprises a generally planar chain link fence panel located in an erect position. In some embodiments, the chain link fence panel comprises a plurality of formed chain link fence wires intertwined to form a mesh chain link fence surface. In some embodiments, the chain link fence panel comprises a plurality of generally diamond-shaped chain link fence openings located in a symmetrical pattern between the chain link fence wires. In some embodiments, each chain link fence opening is faced by a plurality of chain link fence wire interior surfaces.

In some embodiments, the system comprises a base member having a top attachment tongue located on a base posterior surface close to or on a base top. In some embodiments, the top attachment tongue projects out and away from the base posterior surface. In some embodiments, the top attachment tongue comprises a top attachment tongue first groove located on a top attachment tongue first side and a top attachment tongue second groove located on an opposing top attachment tongue second side. In some embodiments, a top attachment tongue neck is located between the top attachment tongue first groove and the top attachment tongue second groove on the top attachment tongue. In some embodiments, a top attachment tongue first tab is formed on the top attachment tongue via the top attachment tongue first groove and the top attachment tongue neck. In some embodiments, a top attachment tongue second tab is formed on the top attachment tongue via the top attachment tongue second groove and the top attachment tongue neck. In some embodiments, the first and second tabs originate from the center of the tongue and the first and second tabs project in opposite directions away from each other. In some embodiments, the first and second tongue grooves are on opposite sides of the tongue neck, and the opening of the first tongue groove opens in a first direction and the opening of the second tongue groove opens in a second direction, wherein the first and second directions are opposite each other.

In some embodiments, the base member flares from the top attachment tongue forming a first side shoulder on a base first side and a second side shoulder on a base second side. In some embodiments, the base member tapers on the base first side and the base second side approaching a base bottom. In some embodiments, a shelf is located on a base anterior surface. In some embodiments, a slotted bat hook having a bat hook first side and a bat hook second side is located on the base bottom.

DESCRIPTION OF PREFERRED EMBODIMENTS

Figure 1:
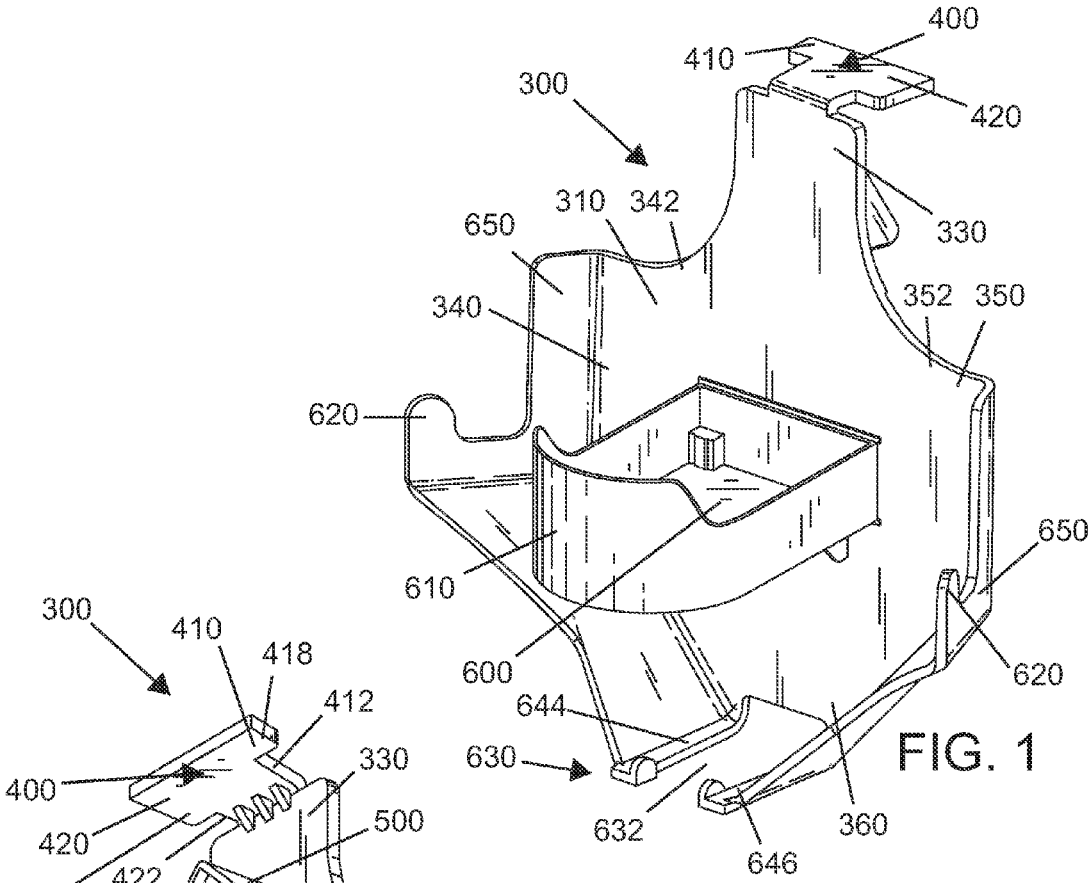
FIG. 1 is a front perspective view of the base member of the present invention.

Following is a list of elements corresponding to a particular element referred to herein:

100 Dugout organization system
200 Chain link fence panel
210 Chain link fence wire
212 Chain link fence wire interior surface
220 Chain link fence panel surface
230 Chain link fence opening
300 Base member
310 Base member anterior surface
320 Base member posterior surface
330 Base top
340 Base first side
342 First side shoulder
350 Base second side

Figure 2:
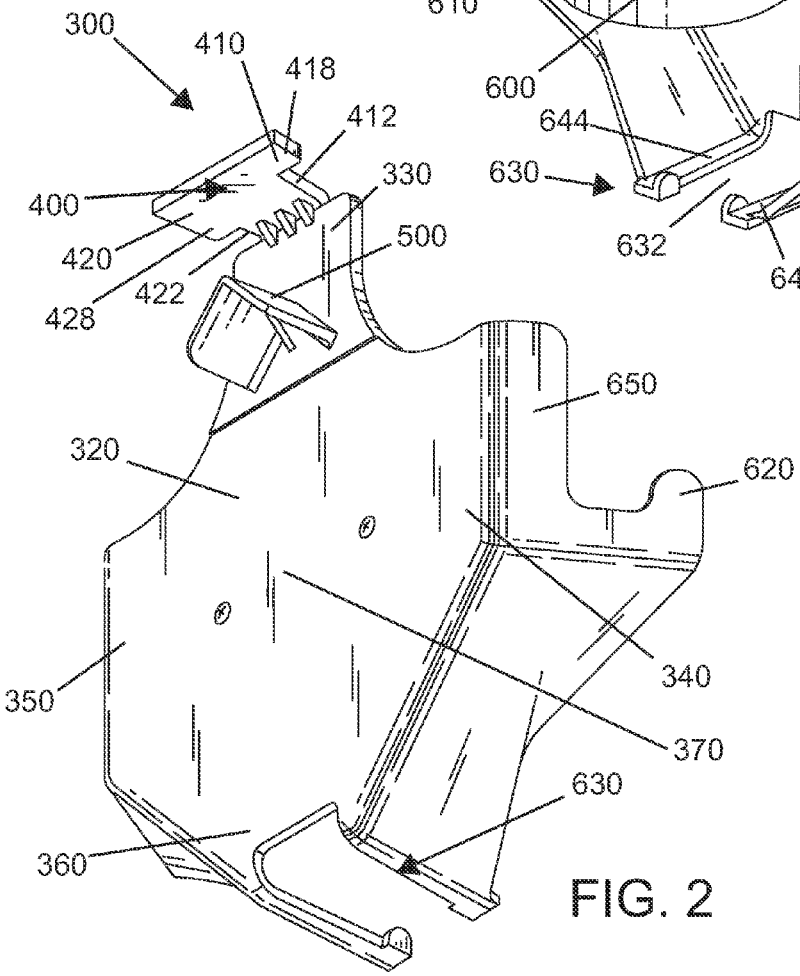
FIG. 2 is a rear perspective view of the base member of the present invention.
Figure 3:
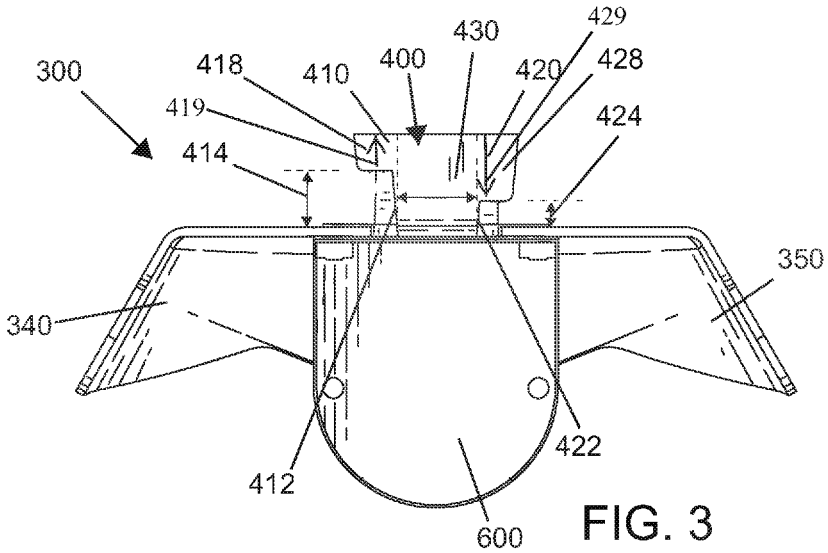
FIG. 3 is a top view of the base member of the present invention.
Figure 4:
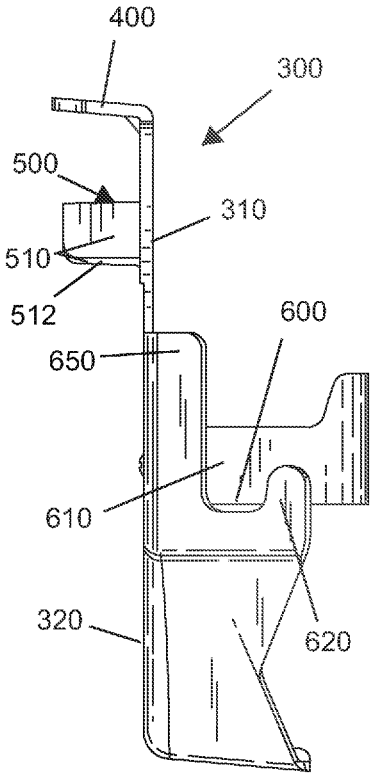
FIG. 4 is a side view of the base member of the present invention.
Figure 5:
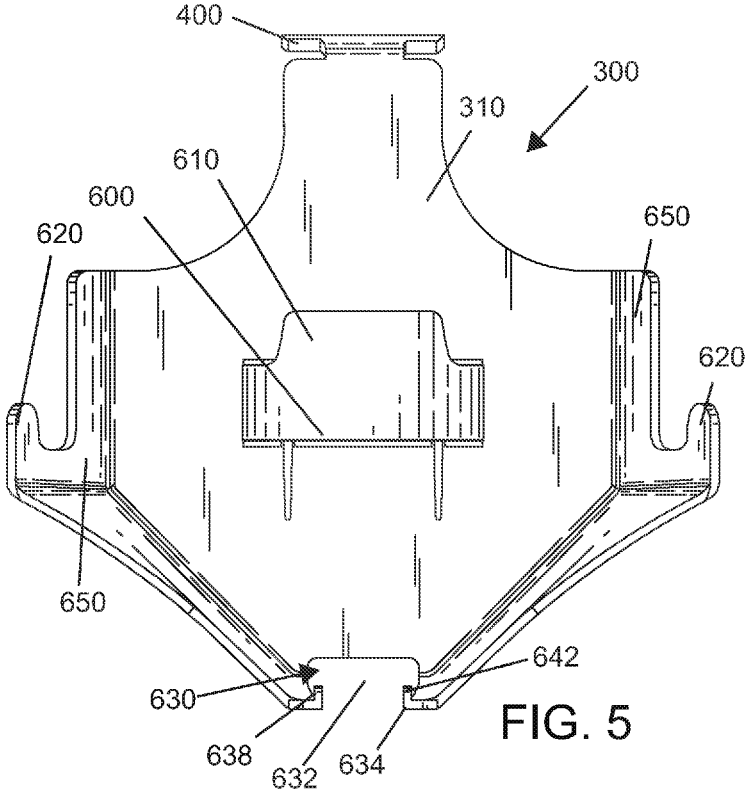
FIG. 5 is a front view of the base member of the present invention.
Figure 6:
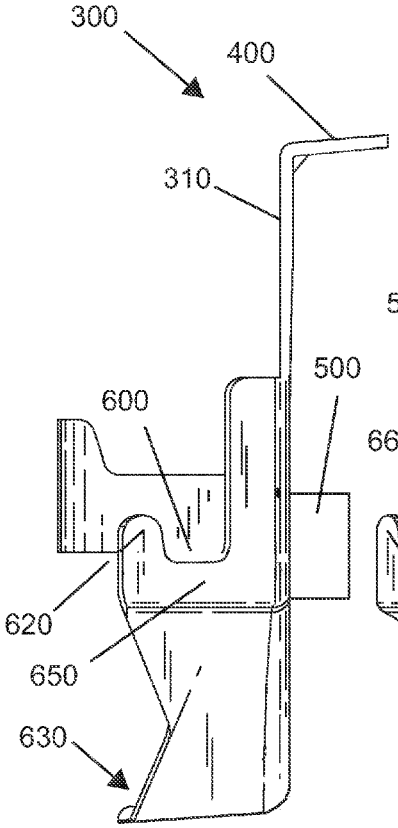
FIG. 6 is a side view of the base member of the present invention.
Figure 7:
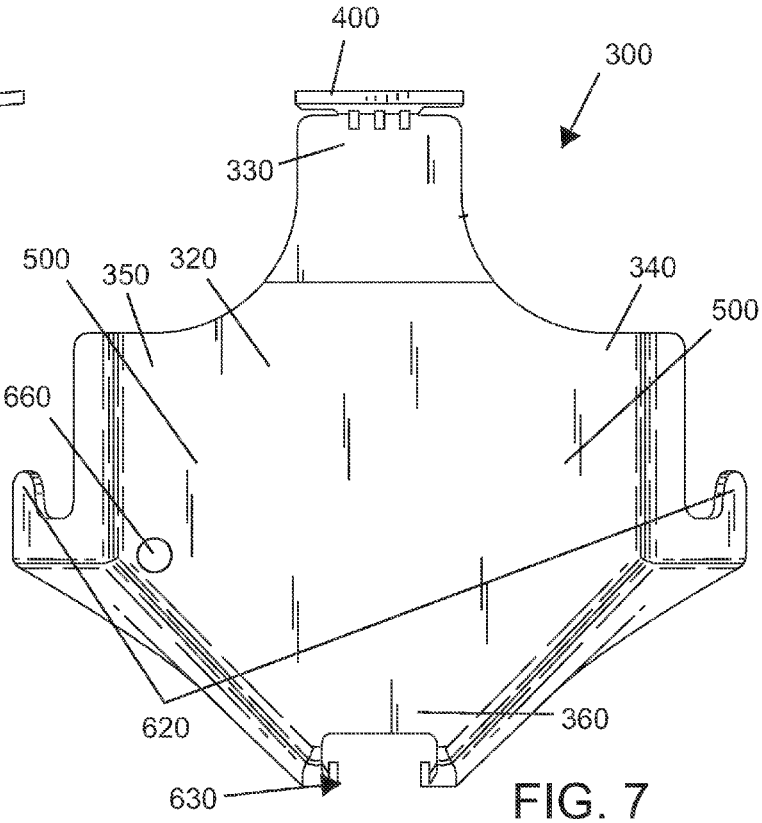
FIG. 7 is a rear view of the base member of the present invention.
Figure 8:
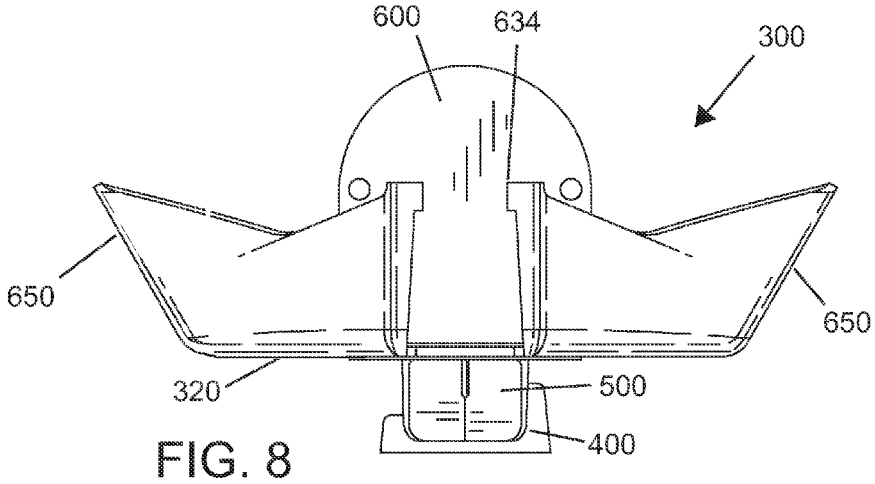
FIG. 8 is a bottom view of the base member of the present invention.
Figure 9:
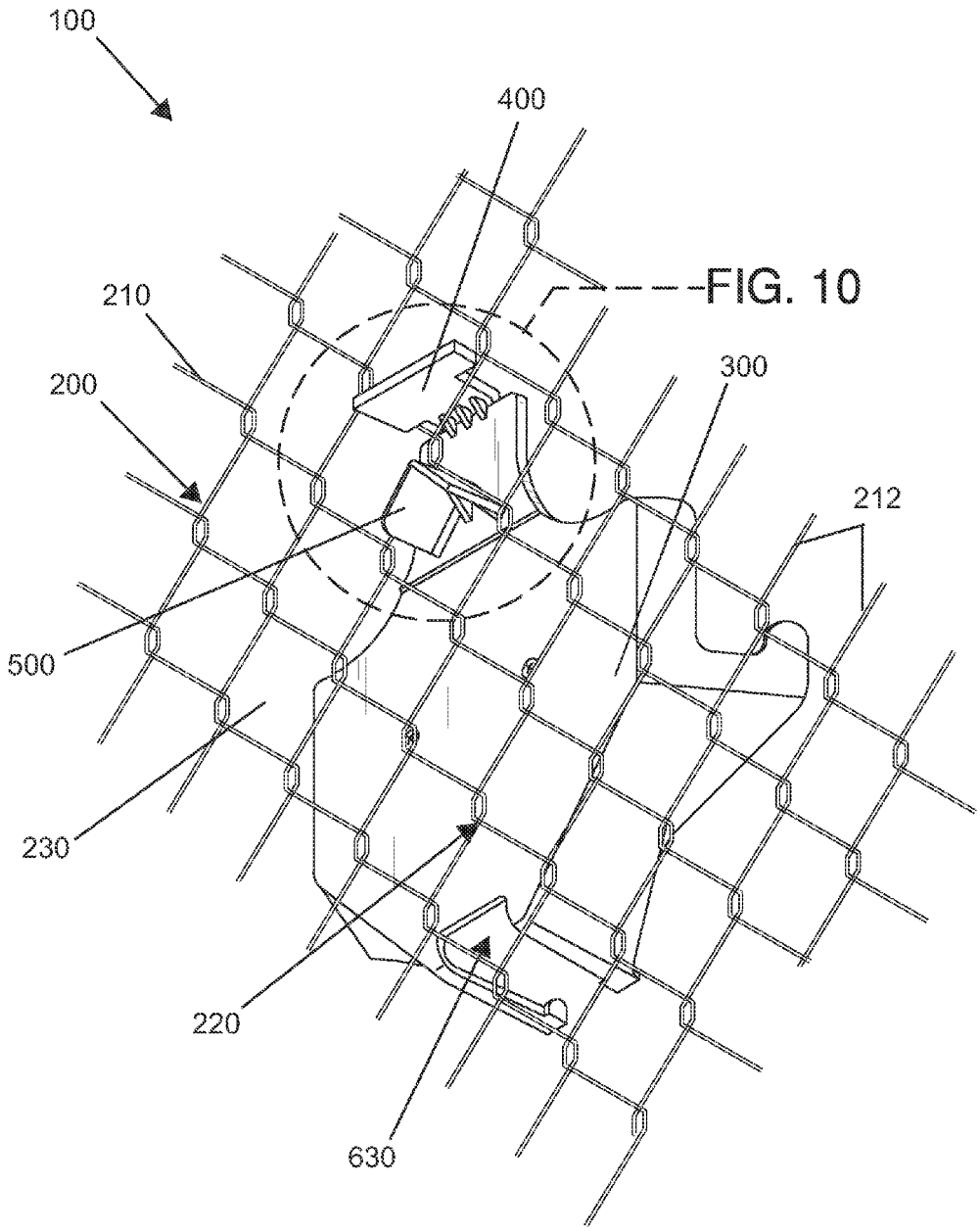
FIG. 9 is a rear perspective view of the present invention.
Figure 10:
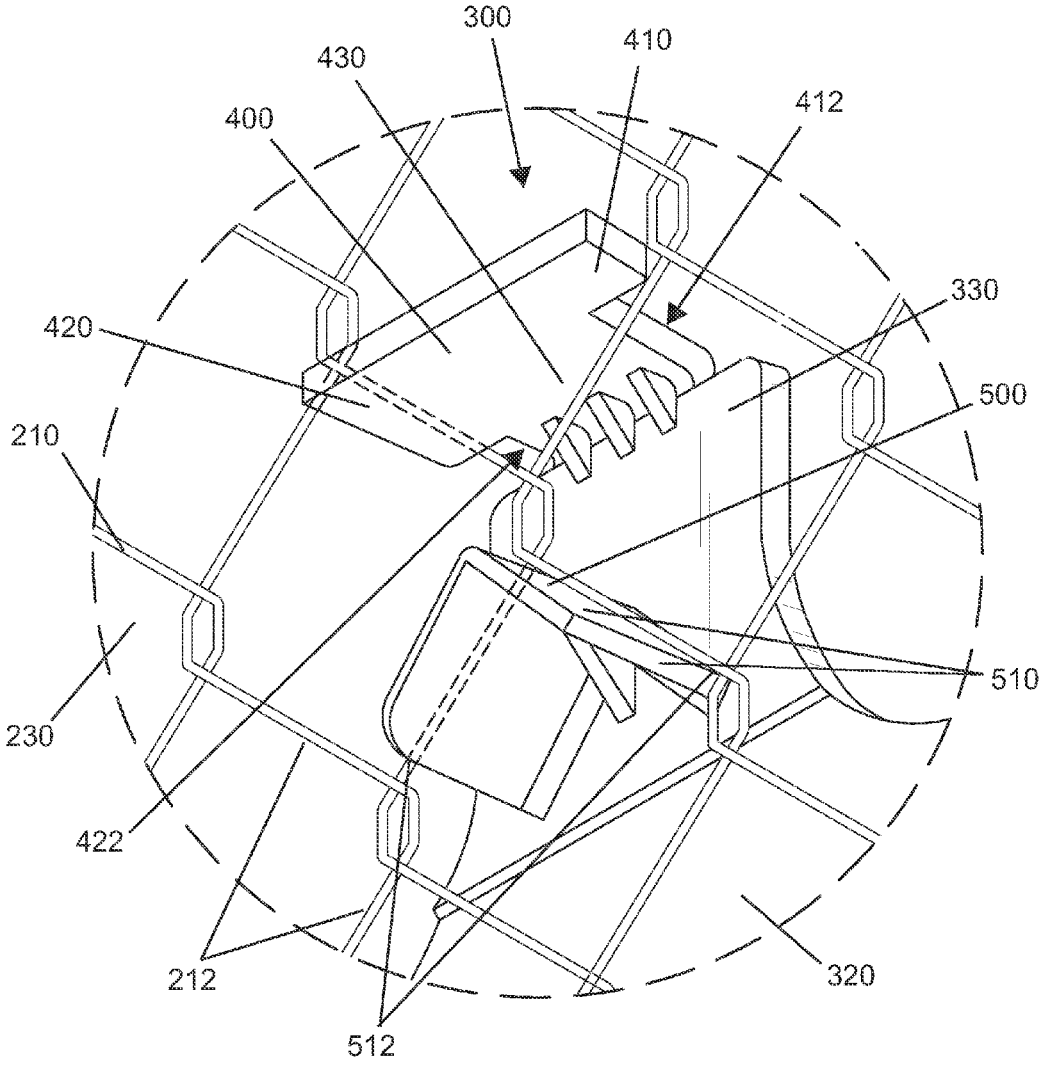
FIG. 10 is a close up rear perspective view of a top attachment tongue and a bottom attachment projection of the present invention.
Figure 11:
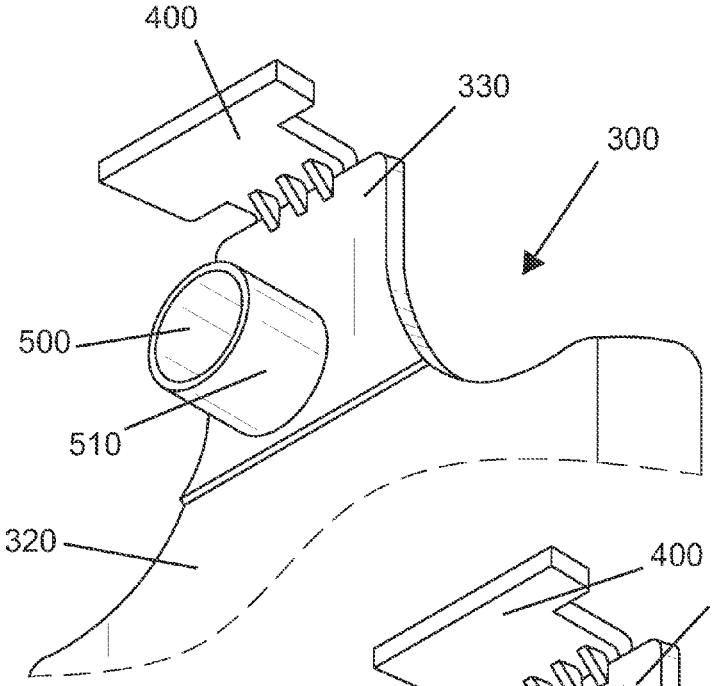
FIG. 11 is a view of an alternate embodiment of a bottom attachment projection of the present invention.
Figure 12:
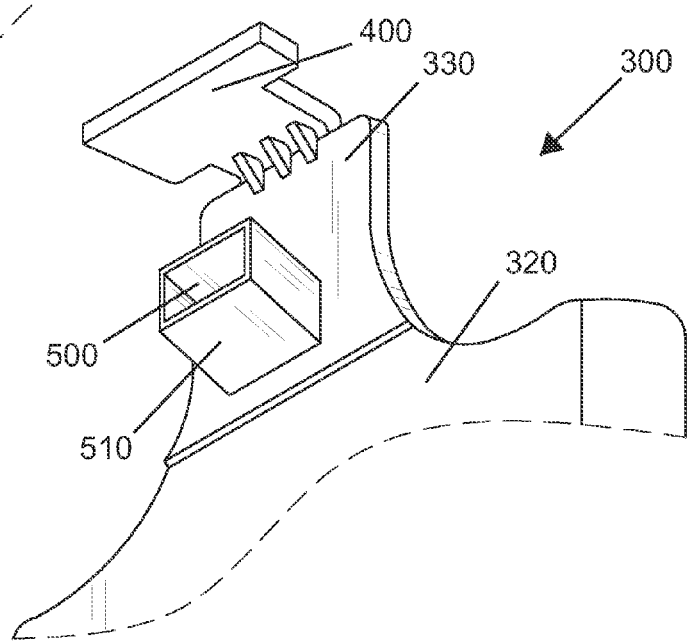
FIG. 12 is a view of an alternate embodiment of a bottom attachment projection of the present invention.

352 Second side shoulder
360 Base bottom
370 Base middle
400 Top attachment tongue
410 Top attachment tongue first side
412 Top attachment tongue first groove
414 First groove width
418 Top attachment tongue first tab
419 Width of top attachment tongue first tab
420 Top attachment tongue second side
422 Top attachment tongue second groove
424 Second groove width
428 Top attachment tongue second tab
429 Width of top attachment tongue second tab
430 Top attachment tongue neck
500 Bottom attachment projection
510 Bottom attachment projection side wall
512 First bottom attachment projection engagement interface
600 Shelf
610 Shelf side
620 Hook
630 Slotted bat hook
632 Slot
634 Slotted bat hook front edge
638 Slotted bat hook first projection
642 Slotted bat hook second projection
644 Bat hook first side
646 Bat hook second side
650 Projecting side panel
660 Aperture Referring now to FIG. 1-12, the present invention features a dugout organization system (100) for baseball or softball equipment for use by a participant in a dugout. In some embodiments, the system (100) comprises a generally planar chain link fence panel (200) located in an erect position. In some embodiments, the chain link fence panel (200) comprises a plurality of formed chain link fence wires (210) intertwined to form a mesh chain link fence surface (220). In some embodiments, the chain link fence panel (200) comprises a plurality of generally diamond-shaped chain link fence openings (230) located in a symmetrical pattern between the chain link fence wires (210). In some embodiments, each chain link fence opening (230) is faced by a plurality of chain link fence wire interior surfaces (212).

In some embodiments, the system (100) comprises a base member (300) having a base anterior surface (310), a base posterior surface (320), a base top (330), a base first side (340), a base second side (350), and a base bottom (360). In some embodiments, the base member (300) comprises a top attachment tongue (400) located on the base posterior surface (320) close to or on the base top (330). In some embodiments, the top attachment tongue (400) projects out and away from the base posterior surface (320).

In some embodiments, the top attachment tongue (400) comprises a top attachment tongue first groove (412) located on a top attachment tongue first side (410) and a top attachment tongue second groove (422) located on an opposing top attachment tongue second side (420). In some embodiments, the top attachment tongue first groove (412) comprises a first groove width (414) for engaging one of the chain link fence wires (210). In some embodiments, the top attachment tongue second groove (422) comprises a second groove width (424) for engaging one of the chain link fence wires (210). In some embodiments, the first groove width (414) is not equal to the second groove width (424). In some embodiments, the first groove width (414) is equal to the second groove width (424).

In some embodiments, the width of the first tab 419 is wider than the width of the second tab 429. In some embodiments, the width of the first tab 419 is narrower than the width of the second tab 429. In some embodiments, the width of the first tab 419 is equal to the width of the second tab 429.

In some embodiments, a top attachment tongue neck (430) is located between the top attachment tongue first groove (412) and the top attachment tongue second groove (422) on the top attachment tongue (400). In some embodiments, a top attachment tongue first tab (418) is formed on the top attachment tongue (400) via the top attachment tongue first groove (412) and the top attachment tongue neck (430). In some embodiments, a top attachment tongue second tab (428) is formed on the top attachment tongue (400) via the top attachment tongue second groove (422) and the top attachment tongue neck (430).

In some embodiments, the base member (300) flares from the top attachment tongue (400) forming a first side shoulder (342) on the base first side (340) and a second side shoulder (352) on the base second side (350). In some embodiments, the base member (300) tapers on the base first side (340) and the base second side (350) approaching the base bottom (360).

In some embodiments, a shelf (600) is located on the base anterior surface (310).

In some embodiments, a slotted bat hook (630) having a bat hook first side (644) and a bat hook second side (646) is located on the base bottom (360). In some embodiments, the slotted bat hook (630) projects out and away from the base anterior surface (310). In some embodiments, the slotted bat hook (630) comprises a slot (632) located between the bat hook first side (644) and the bat hook second side (646) from a slotted bat hook front edge (634) for receiving a handle of a bat. In some embodiments, the slotted bat hook (630) comprises a slotted bat hook first projection (638) and a slotted bat hook second projection (642) for securely holding the bat.

In some embodiments, for use, the top attachment tongue (400) of the base member (300) is inserted into one of the chain link fence openings (230) and interlocked with the chain link fence panel (200) via the top attachment tongue first groove (412) and the top attachment tongue second groove (422) engaging the chain link fence wires (210). In some embodiments, the base posterior surface (320) rests against the chain link fence surface (220).

In some embodiments, a bottom attachment projection (500) is located on the base posterior surface (320). In some embodiments, the bottom attachment projection (500) projects out and away from the base posterior surface (320). In some embodiments, the bottom attachment projection (500) comprises a bottom attachment projection side wall (510) located thereon.

In some embodiments, the bottom attachment projection (500) is located at an offset from the top attachment tongue (400) to provide for engagement with a second one of the chain link fence openings (230) located beneath a first one of the chain link fence openings (230) upon installation of the top attachment tongue (400) into the first one of the chain link fence openings (230).

In some embodiments, when the bottom attachment projection (500) projects through the second one of the chain link fence openings (230) between two of the intertwined chain link fence wires (210), the bottom attachment projection side wall (510) engages at least one of the chain link fence wire interior surfaces (212) at a first bottom attachment projection engagement interface (512).

In some embodiments, the bottom attachment projection (500) is located close to a base middle (370) between the base first side (340) and the base second side (350). In some embodiments, the bottom attachment projection (500) is located close to the base first side (340) and a second bottom attachment projection (500) is located on the base posterior surface (320) close to the base second side (350). In some embodiments, the bottom attachment projection (500) is disposed proximal to a base middle (370) between the base first side (340) and the base second side (350). In some embodiments, the bottom attachment projection (500) is disposed proximal to the base first side (340) and a second bottom attachment projection (500) is disposed on the base posterior surface (320) proximal to the base second side (350).

In some embodiments, there are two or more bottom attachment projections (500) disposed on and project away from the base posterior surface (320).

In some embodiments, a fence mesh size measured from a first one of the chain link fence wires (210) to an opposing second one of the chain link fence wires (210) is between about 1 inch to about 2⅛ inches.

In some embodiments, each chain link fence wire (210) size is between about 6 gage and about 12.5 gage.

In some embodiments, the shelf (600) comprises a shelf side (610) located on an edge of the shelf (600). In some embodiments, the shelf (600) is semicircular and designed to hold a sports drink or a water bottle.

In some embodiments, a hook (620) is located on the base first side (340). In some embodiments, the hook (620) projects outwardly away from the base anterior surface (340) and also upwardly in a direction of the base top (330).

In some embodiments, a hook (620) is located on the base second side (350). In some embodiments, the hook (620) projects outwardly away from the base anterior surface (340) and also upwardly in a direction of the base top (330).

In some embodiments, the base comprises a first hook (620) disposed on the base first side (340), wherein the hook (620) projects outwardly away from the base anterior surface (310) and also upwardly towards the base top (330), and a second hook (620) disposed on the base second side (350), wherein the hook (620) projects outwardly away from the base anterior surface (310) and also upwardly towards the base top (330).

In some embodiments, the base member (300) comprises a projecting side panel (650) located on the base first side (340). In some embodiments, the projecting side panel (650) projects out and away from the base member anterior surface (310). In some embodiments, the projecting side panel (650) projects straight. In some embodiments, the projecting side panel (650) flares outward.

In some embodiments, the base member (300) comprises a projecting side panel (650) located on the base second side (350). In some embodiments, the projecting side panel (650) projects out and away from the base member anterior surface (310). In some embodiments, the projecting side panel (650) projects straight. In some embodiments, the projecting side panel (650) flares outward.

In some embodiments, the base member (300) comprises an aperture (660) located therein. In some embodiments, the aperture (660) is used to secure the base member (300) to the chain link fence panel (200). In some embodiments, the aperture (660) is disposed close to or adjacent to the shelf (600).

The Holding Device

The holding device shall not be modified or re-worked to any other shape, including but not limited to, an oval, square, triangular, rectangular, circular, pentagon, hexagon, octagon, cube, trapezoid, triangle, sphere and/or any other possible shape modification.

Both front and back surfaces shall not be modified or re-worked to any other shape, including but not limited to, oval, square, triangular, rectangular, circular, pentagon, hexagon, octagon, cube, trapezoid, triangle, sphere and/or any other possible shape modification.

First side edges and second side edges shall not be modified, re-worked, extended or reduced to any other shape, including but not limited to, small, medium, large or height and lengths nor thinner or thicker.

Side edges shall not be modified, re-worked, extended or reduced to any other shape, including but not limited to, small, medium, large or height and lengths nor thinner or thicker.

The holding device platform shah not be modified, re-worked, extended or reduced to any other shape, including but not limited to, small, medium, large or height and lengths nor thinner or thicker.

The extension platform from the front of the base of the bottle holder shall not be modified, re-worked, extended or reduced to any other shape, including but not limited to, oval, square, triangular, rectangular, circular, pentagon, hexagon, octagon, cube, trapezoid, triangle and sphere to any other size of height and lengths nor thinner or thicker or extended from middle area.

The first hook extended to the first side edge to hold first objects such as a helmet, glove, jacket or visor to of the base shall not be modified, re-worked, extended or reduced to any other shape, including but not limited to, heights, lengths, widths or extend outwardly or inwardly. A second hook from second side edge to hold a second object such as a helmet, glove, jacket or visor of the base shall not be modified, re-worked, extended or reduced to any other shape, including but not limited to, heights, lengths, widths or extend outwardly or inwardly.

A two-prong bracket function to hold a fourth object extended outwardly from the bottom edge of the base of to hold a bat shall not be modified, re-worked, extended or reduced to any other shape, including but not limited to, an oval, square, triangular, rectangular, circular, pentagon, hexagon, octagon, cube, trapezoid, triangle, sphere and/or any other possible shape modification and shall not be modified to any other shape, including but not limited to, any other form or sizes small, medium, large or height and lengths nor thinner or thicker.

The slot is between the two prong brackets. The slot shall not be modified, re-worked, extended or reduced to any other shape, including but not limited to, various sizes of shapes, oval, square, triangular, rectangular, circular, pentagon, hexagons, octagon, cube, trapezoid, triangles and sphere and shall not be changed in any form or sizes small, medium, large or height and lengths nor thinner or thicker to a accommodate various objects.

The feature that extends from the base shall not be modified, re-worked, extended or reduced to any other shape including but not limited to, oval, square, triangular, rectangular, circular, pentagon, hexagons, octagon, cube, trapezoid, triangles and sphere shall not be modified to any other shape, including but not limited to, any other sizes small, medium, large or height and lengths nor thinner or thicker to a accommodate various objects.

The feature at the end of the base shall not be modified, re-worked, extended or reduced to any other shape, including but not limited to, oval, square, triangular, rectangular, circles, pentagon, hexagons, octagon, cube, trapezoid, triangles and sphere and shall not be modified to any other shape, including but not limited to, sizes small, medium, large or height and lengths nor thinner or thicker to a accommodate various objects.

The top mounting configuration attaches to and extends outwardly away from back surface of base (via a pivot component) with a wing to form a groove at a point where the first mounting component and the back surface of the base connect to the wings to be able to hang on a fence shall not be modified, re-worked, extended or reduced to any other shape, including but not limited to, oval, square, triangular, rectangular, circular, pentagon, hexagons, octagon, cube, trapezoid, triangles and sphere and shall not be modified, re-worked, extended or reduced to any other shape, including but not limited to, sizes small, medium, large or height and lengths nor thinner or thicker flat surface with wings.

The second mounting component is V shaped and shall not be modified, re-worked, multiplied, moved to different locations, extended or reduced to any other size shape, including but not limited to, oval, square, triangular, rectangular, circular, pentagon, hexagon, octagon, cube, trapezoid, triangles, sphere, sizes small, medium, large or height and lengths nor thinner or thicker on the back of the surface or in the back of extension.

A feature that supports both sides of another feature shall not be modified, re-worked, extended or reduced to any other shape, including but not limited to, oval, square, triangular, rectangular, circular, pentagon, hexagons, octagon, cube, trapezoid, triangles and sphere and shall not be modified or re-worked to any other shape, including but not limited to, sizes small, medium, large or height and lengths nor thinner or thicker to a accommodate various objects.

As used herein, the term "about" refers to plus or minus 10% of the referenced number.

The disclosures of the following U.S. Patents are incorporated in their entirety by reference herein: U.S. Patent Pub. No. 2006/0086878; U.S. Pat. No. 6,695,155; and U.S. Pat. No. 3,653,624.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A dugout organization system (100) for baseball or softball equipment for use by a participant in a dugout, wherein said system (100) comprises:

(a) a generally planar chain link fence panel (200) disposed in an erect position, wherein the chain link fence panel (200) comprises a plurality of formed chain link fence wires (210) intertwined to form a mesh chain link fence surface (220), wherein the chain link fence panel (200) comprises a plurality of generally diamond-shaped chain link fence openings (230) disposed in a symmetrical pattern between the chain link fence wires (210); and (b) a base member (300) having a base anterior surface (310), a base posterior surface (320), a base top (330), a base first side (340), a base second side (350), and a base bottom (360), wherein the base top (330) is directly on the opposing side to the base bottom (360) relative to the base member (300);

wherein the base member (300) comprises a top attachment tongue (400) disposed on the base posterior surface (320) proximal to the base top (330), wherein the top attachment tongue (400) projects out and away from the base posterior surface (320);

wherein the top attachment tongue (400) comprises a top attachment tongue first groove (412) disposed on a top attachment tongue first side (410) and a top attachment tongue second groove (422) disposed on an opposing top attachment tongue second side (420), wherein the top attachment tongue first groove (412) comprises a first groove width (414) for engaging one of the chain link fence wires (210), wherein the top attachment tongue second groove (422) comprises a second groove width (424) for engaging one of the chain link fence wires (210), wherein the first groove width (414) is not equal to the second groove width (424);

wherein a top attachment tongue neck (430) is disposed between the top attachment tongue first groove (412) and the top attachment tongue second groove (422) on the top attachment tongue (400), wherein a top attachment tongue first tab (418) is formed on the top attachment tongue (400) via the top attachment tongue first groove (412) and the top attachment tongue neck (430), wherein a top attachment tongue second tab (428) is formed on the top attachment tongue (400) via the top attachment tongue second groove (422) and the top attachment tongue neck (430);

wherein the base member (300) flares from the top attachment tongue (400) forming a first side shoulder (342) on the base first side (340) and a second side shoulder (352) on the base second side (350), wherein the base first side (340) and the base second side (350) taper towards each other down to the base bottom (360);

wherein a shelf (600) is disposed on the base anterior surface (310) at a location between the base top (330) and the base bottom (360), and between the base first side (340) and base second side (350), wherein the shelf (600) projects away from the base anterior surface (310);

wherein a slotted bat hook (630) having a bat hook first side (644) and a bat hook second side (646) is disposed on the base bottom (360), wherein the slotted bat hook (630) projects out and away from the base anterior surface (310), wherein the slotted bat hook (630) comprises a slot (632) disposed between the bat hook first side (644) and the bat hook second side (646) for receiving a handle of a bat;

wherein for use, the top attachment tongue (400) of the base member (300) is inserted into one of the chain link fence openings (230) and interlocked with the chain link fence panel (200) via the top attachment tongue first groove (412) and the top attachment tongue second groove (422) engaging the chain link fence wires (210), wherein the base posterior surface (320) faces the chain link fence surface (220).

2. The system (100) of claim 1 wherein a bottom attachment projection (500) is disposed on the base posterior surface (320), wherein the bottom attachment projection (500) projects out and away from the base posterior surface (320);

wherein the bottom attachment projection (500) is disposed at an offset from the top attachment tongue (400) to provide for engagement with one of the chain link fence openings (230).

3. The system (100) of claim 1, wherein each chain link fence wire (210) size is between about 6 gage and about 12.5 gage.

4. The system (100) of claim 1, wherein the shelf (600) comprises a shelf side (610) disposed on an edge of the shelf (600).

5. The system (100) of claim 1 wherein a hook (620) is disposed on the base first side (340), wherein the hook (620) projects outwardly away from the base anterior surface (310) and also upwardly towards the base top (330).

6. The system (100) of claim 1, wherein a hook (620) is disposed on the base second side (350), wherein the hook (620) projects outwardly away from the base anterior surface (310) and also upwardly towards the base top (330).

7. The system (100) of claim 1, wherein the base member (300) comprises a projecting side panel (650) disposed on the base first side (340), wherein the projecting side panel (650) projects out and away from the base member anterior surface (310).

8. The system (100) of claim 1, wherein the base member (300) comprises a projecting side panel (650) disposed on the base second side (350), wherein the projecting side panel (650) projects out and away from the base member anterior surface (310).

* * * * *